US006802800B1

(12) United States Patent
Hobson

(10) Patent No.: US 6,802,800 B1
(45) **Date of Patent: *Oct. 12, 2004**

(54) VARIABLE RESISTANCE SQUAT EXERCISE MACHINE

(75) Inventor: Tyler J. Hobson, Montgomery, TX (US)

(73) Assignee: Pendulum Fitness, Inc., Montgomery, TX (US)

( * ) Notice: Subject to any disclaimer, the term of this patent is extended or adjusted under 35 U.S.C. 154(b) by 312 days.

This patent is subject to a terminal disclaimer.

(21) Appl. No.: 09/607,472

(22) Filed: Jun. 30, 2000

Related U.S. Application Data

(63) Continuation-in-part of application No. 09/346,476, filed on Jul. 1, 1999, now Pat. No. 6,350,219.

(51) Int. Cl.[7] ..... A63B 21/08; A63B 23/00

(52) U.S. Cl. ..... 482/97; 482/137; 482/139; 482/908

(58) Field of Search ..... 482/93, 94, 97, 482/98, 100, 135–138

(56) References Cited

U.S. PATENT DOCUMENTS

| | | | | | |
|---|---|---|---|---|---|
| 684,688 | A | | 10/1901 | Herz | |
| 1,007,526 | A | | 10/1911 | Caro | |
| 2,855,199 | A | | 10/1958 | Noland et al. | |
| 3,475,024 | A | | 10/1969 | Lewis | |
| 3,558,130 | A | | 1/1971 | Anderson | |
| 3,856,297 | A | | 12/1974 | Schnell | |
| 4,256,302 | A | | 3/1981 | Keiser et al. | |
| 4,509,746 | A | | 4/1985 | Mask | |
| 4,621,810 | A | | 11/1986 | Cummins | |
| 4,627,619 | A | | 12/1986 | Rockwell et al. | |
| 4,634,127 | A | * | 1/1987 | Rockwell | 482/98 |
| 4,795,149 | A | * | 1/1989 | Pearson | 482/98 |
| 4,834,396 | A | | 5/1989 | Schnell | |
| 4,854,578 | A | | 8/1989 | Fulks | |
| 4,884,801 | A | | 12/1989 | Schnell | |
| 4,930,768 | A | * | 6/1990 | Lapcevic | 482/100 |
| 4,982,956 | A | * | 1/1991 | Lapcevic | 482/100 |
| 5,050,868 | A | * | 9/1991 | Pearson | 482/94 |
| 5,050,873 | A | | 9/1991 | Jones | |
| 5,058,884 | A | | 10/1991 | Fuller, Sr. | |
| 5,106,080 | A | | 4/1992 | Jones | |
| 5,116,297 | A | * | 5/1992 | Stonecipher | 482/97 |
| 5,135,449 | A | | 8/1992 | Jones | |

(List continued on next page.)

OTHER PUBLICATIONS

Hammer Strength Product Information Guide, Mar. 1998, pp. 1–12.
Life Fitness Brochure, 1997, all pages.

*Primary Examiner*—Nicholas D. Lucchesi
*Assistant Examiner*—Victor K. Hwang
(74) *Attorney, Agent, or Firm*—Keith B. Willhelm

(57) ABSTRACT

An exercise machine for performing squat exercises is provided for. The exercise machine comprises a support frame with a shaft horizontally mounted on the frame for rotation about its longitudinal axis. There is at least one weight arm connected to the shaft. The weight arm is adapted to carry a weight at a point distant from the connection between the weight arm and the rotating shaft. Thus, the weight arm provides resistance and load as the shaft rotates. The novel squat machines also comprise a work arm that is connected to the shaft such that actuation of the work arm causes the shaft to rotate. A yoke is connected to the work arm. The yoke is adapted to accommodate the shoulders of an exerciser such that the exerciser is able to provide upward force on the work arm in opposition to the resistance of the weight arm by performing a squat exercise. When the exerciser performs the squat, the work arm causes the shaft to rotate and the weight arm to travel along an arcuate path. Thus, the resistance to rotation provided by the weight arm varies as the weight arm travels along its arcuate path.

22 Claims, 2 Drawing Sheets

U.S. PATENT DOCUMENTS 5,184,991 A 2/1993 Brangi
5,336,148 A * 8/1994 Ish, III ..... 482/97
5,358,462 A 10/1994 Calderone
5,529,558 A * 6/1996 Koenig ..... 482/97
5,769,757 A 6/1998 Fulks
6,350,219 B1 * 2/2002 Hobson ..... 482/97
6,364,815 B1 * 4/2002 Lapcevic ..... 482/97

* cited by examiner

VARIABLE RESISTANCE SQUAT EXERCISE MACHINE

CLAIM TO PRIORITY

This application is a continuation-in-part of U.S. Ser. No. 09/346,476, filed Jul. 1, 1999; now U.S. Pat. No. 6,350,219B1.

FIELD OF THE INVENTION

This invention relates to an improved variable resistance, weight training exercise machine and, in particular, to an improved variable resistance weight machine that is adapted for squat exercises.

BACKGROUND OF THE INVENTION

Many persons use weight training to develop strength, to enhance their personal appearance, or to rehabilitate injuries. Typically, an exerciser will use either a weight exercise machine or various types of free weights, such as dumbbells, barbells, and weighted plates. Both types of weight training have advantages and disadvantages.

Free weights are generally more inexpensive and more versatile than weight exercise machines. One set of free weights can be used to work many different muscle groups. Free weights also offer an improved range of motion over exercise machines, which are restricted to one plane of movement.

The primary disadvantage of free weights is safety. Because free weights are not restricted to a particular range of motion, as in weight machines, various mishaps can occur. An exerciser can drop a weight on himself, a bar can become unbalanced while adding or removing weights, or an exerciser could be trapped underneath a weighted bar. Because of those safety risks, most exercisers who use free weights have to work out in pairs or specialized facilities to protect themselves. That also limits the exerciser to times and places where they can work out.

Because of the disadvantages of free weights, exercise machines have become more common, especially in commercial facilities where liability concerns over free weights are present. Weight exercise machines avoid the risk of certain injuries because the weights are usually restricted to a certain range of motion. Thus, if properly loaded on the machine, weights cannot fall on an exerciser, nor can the exerciser be pinned under a bar loaded with weights. Exercise machines also tend to be more stable. Weights typically can be added or removed from machines without risking an imbalance that could cause a weight to fall on and injure an exerciser.

The prior art has countless disclosures relating to exercise machines designed for improving the muscle characteristics of different muscle groups. Such prior art machines include multistation machines, i.e., machines that allow an exerciser to perform more than one type of exercise, as well as single station machines that are specially adapted to a particular exercise. For example, U.S. Pat. No. 5,184,991, discloses a multistation exercise machine for performing various exercises designed to work different muscle groups. That multistation machine uses a series of cables, pulleys, and levers that transmit the resistance and load of weights while restricting the weights to a particular range of motion. U.S. Pat. No. 5,135,449 discloses a single station machine designed to provide rowing exercise. That machine uses a pair of levers to provide the resistance to an exerciser.

Multistation exercise machines have an advantage in that they are capable of providing a variety of exercises in a relatively compact machine. Multistation machines also can be manufactured and sold more economically, thus making them more suitable for the home market than are single station machines. An example of a multistation machine having such advantages is disclosed in applicant's copending U.S. application, Ser. No. 09/346,476, filed on Jul. 1, 1999, the disclosure of which is hereby incorporated by reference. It allows an exerciser to perform a wide variety of exercises, such as lat pull downs, military presses, chest presses, triceps extensions, seated dips, biceps curls, low rows, lying leg presses, squats, dead lifts, abdominal crunches, leg extensions, seated leg curls, and lat pull-overs, and it is easily and economically fabricated.

Single station machines, however, are generally preferred in the commercial market where there are many exercisers sharing the same equipment. Gyms, health clubs, and professional training facilities prefer to have an array of single station machines, each specially adapted for a particular exercise. Exercisers do not have to spend time making adjustments that often are necessary in a multistation machine in order to adapt it to a different exercise.

Whether single station or multistation, however, many exercise machines are relatively difficult and costly to build. Many designs require a relatively large number of specialized components such as levers, pulleys, cables, and the like. Such specialized components increase the complexity of the design and the time to assemble the machines. The cost to build and repair such machines also is relatively high when compared with those that do not require specialized components.

In addition, free weights and most exercise machines on the market today are designed to provide a constant resistance and load over the entire range of motion in an exercise. Preferably, the resistance and, thereby, the force needed to move a given weight could be varied over the range of motion needed to perform an exercise such that an exerciser encounters the greatest resistance when his muscoskeletal system is in the best position to bear the greatest resistance. Likewise, the load provided by weights preferably would vary over the range of motion. Variable resistance and load also can allow for more efficient weight training by causing muscle groups to work hardest at a specified range of motion or by focusing greater resistance and load on different muscle groups. They can help prevent injury as well by allowing an exerciser to exert less force at vulnerable points in a range of motion during an exercise.

For example, one of the most popular exercises in weight training is the squat. In a squat, an exerciser lifts a weight from a squatting position to an upright position. During the initial range of motion, as the exerciser is rising from the lowest, squatting position, he is at the greatest risk of back injury. It would be preferable to allow the exerciser to initially lift the weight with less force at this vulnerable position. Then, as the exerciser continues through the range of motion to a more upright posture, where the risk of injury is lessened and the muscoskeletal system is capable of bearing greater weight, the force necessary to move the weight preferably would increase.

Through the initial range of motion in a squat, the gluteus maximus and hamstrings of an exerciser provide the majority of the lift needed to overcome the resistance of the weights. As the exerciser becomes more upright, however, the quadriceps provide most of the lift. Many squat exercise machines, however, are unable to vary the resistance such that those separate muscle groups are isolated and preferentially worked during a squat.

At the same time, however, many exercisers enjoy competition. Free weights typically are used in competition, and thus, it is important that training machines can provide more or less uniform resistance and load matching the nominal weight of standard weights. That is, a variable resistance exercise machine should be designed that an exerciser can lift approximately the same weight, through the same resistance profile on a training machine as he would be able to do with free weights in competition.

An object of the subject invention, therefore, is to provide a squat exercise that provides a reduced risk of injury to an exerciser during weight training.

Another object is to provide a squat machine in which the weights are restricted to a defined range of motion such that an exerciser may safely exercise without the assistance of others.

It also is an object of the invention to provide a variable resistance squat exercise machine.

Another object of the subject invention is to provide a squat exercise machine that has substantially constant resistance so as to replicate more closely the resistance profile and nominal resistance of free weights.

Yet another object is to provide a variable resistance squat exercise machine that is able to isolate and focus resistance on the major muscle groups required to perform a squat.

Yet another object of the subject invention is to provide a squat exercise machine that is more easily manufactured and assembled.

It is a further object of this invention to provide a squat exercise machine wherein some or all of the above-mentioned advantages are realized.

Those and other objects and advantages of the invention will be apparent to those skilled in the art upon reading the following detailed description and upon reference to the drawings.

SUMMARY OF THE INVENTION

The subject invention provides for an exercise machine for performing squat exercises. The exercise machine comprises a support frame with a shaft horizontally mounted on the frame for rotation about its longitudinal axis. There is at least one weight arm connected to the shaft. The weight arm is adapted to carry a weight at a point distant from the connection between the weight arm and the rotating shaft. Thus, the weight arm provides resistance and load as the shaft rotates. (Although they are technically distinct concepts, resistance and load are commonly, and at times may be referred to herein in a collective sense as simply resistance.)

The novel squat machines also comprise a work arm that is connected to the shaft such that actuation of the work arm causes the shaft to rotate. A yoke is connected to the work arm. The yoke is adapted to accommodate the shoulders of an exerciser such that the exerciser is able to provide upward force on the work arm in opposition to the resistance of the weight arm by performing a squat exercise. When the exerciser performs the squat, the work arm causes the shaft to rotate and the weight arm to travel along an arcuate path. Thus, the resistance to rotation provided by the weight arm varies as the weight arm travels along its arcuate path.

It will be appreciated, therefore, that because the motion of the weight arm follows an arcuate path the resistance provided during a squat exercise varies. Moreover, the arcuate path may be predetermined such that there is relatively less weight resistance during the vulnerable, initial range of motion in a squat. Because the weight arm's range of motion is restricted, the machine also provides increased safety and allows an exerciser to work out alone.

Preferably, the work arm carries one or more second weights at a point distant from the connection between the work arm and the rotating shaft. Such weights provide resistance to upward movement of the work arm, and like the weights carried on the weight arms, the second weights also travel along an arcuate path. Thus, the resistance to upward movement of the work arm varies during a squat exercise.

More particularly, as an exerciser assumes an initial, squatting position, the weights on the weight arm preferably are carried at a position of between 180° and 270°. Thus, as the exerciser rises from the squatting position, the work arm causes the shaft to rotate in a clockwise direction, which in turn causes the weight arm and its associated weights to travel clockwise along an arcuate path.

The resistance provided by those weights, therefore, will increase as they travel along their arcuate paths. Preferably, the weights are approaching horizontal as the exerciser is approaching his full upright position and finishes in a substantially horizontal position. Thus, the weights on the weight arm will provide less resistance when the exerciser is in the vulnerable, squatting position. They will provide the greatest resistance near the finish position at a point where the quadriceps are providing the greatest lift and the exerciser is at less risk of injury.

As for the second weights carried on the work arm, preferably they are positioned between 270° and 0° when the exerciser is in the initial, squatting position. As the exerciser lifts the work arm, the second weights travel along an arcuate path to a substantially vertical finishing position. Thus, the resistance provided by the second weights decreases as the exerciser progresses toward the finishing position. Because the exerciser is a greatest risk of injury in his squatting position, typically the work arm will not carry as much weight and provide as much resistance as the weights on the weight arms.

It will be appreciated, however, that by selectively varying the amount of weight carried on the weight arms and on the work arms, the novel exercise machines may focus resistance either through the initial range of motion in a squat exercise, where most of the lift is provided by the gluteus maximus and hamstrings, or through the latter range of motion, where most of the lift is provided by the quadriceps.

The first and second weights also may be selected such that the increasing resistance of the weights on the weight arms is substantially offset by the decreasing resistance provided by the work arm weights. Thus, the overall resistance provided by the machine may be made substantially constant over the entire range of motion and made to match the nominal resistance of free weights.

These and other features of the invention will be more readily understood in view of the following detailed description and drawings.

DESCRIPTION OF ILLUSTRATIVE EMBODIMENTS

Figure 1:
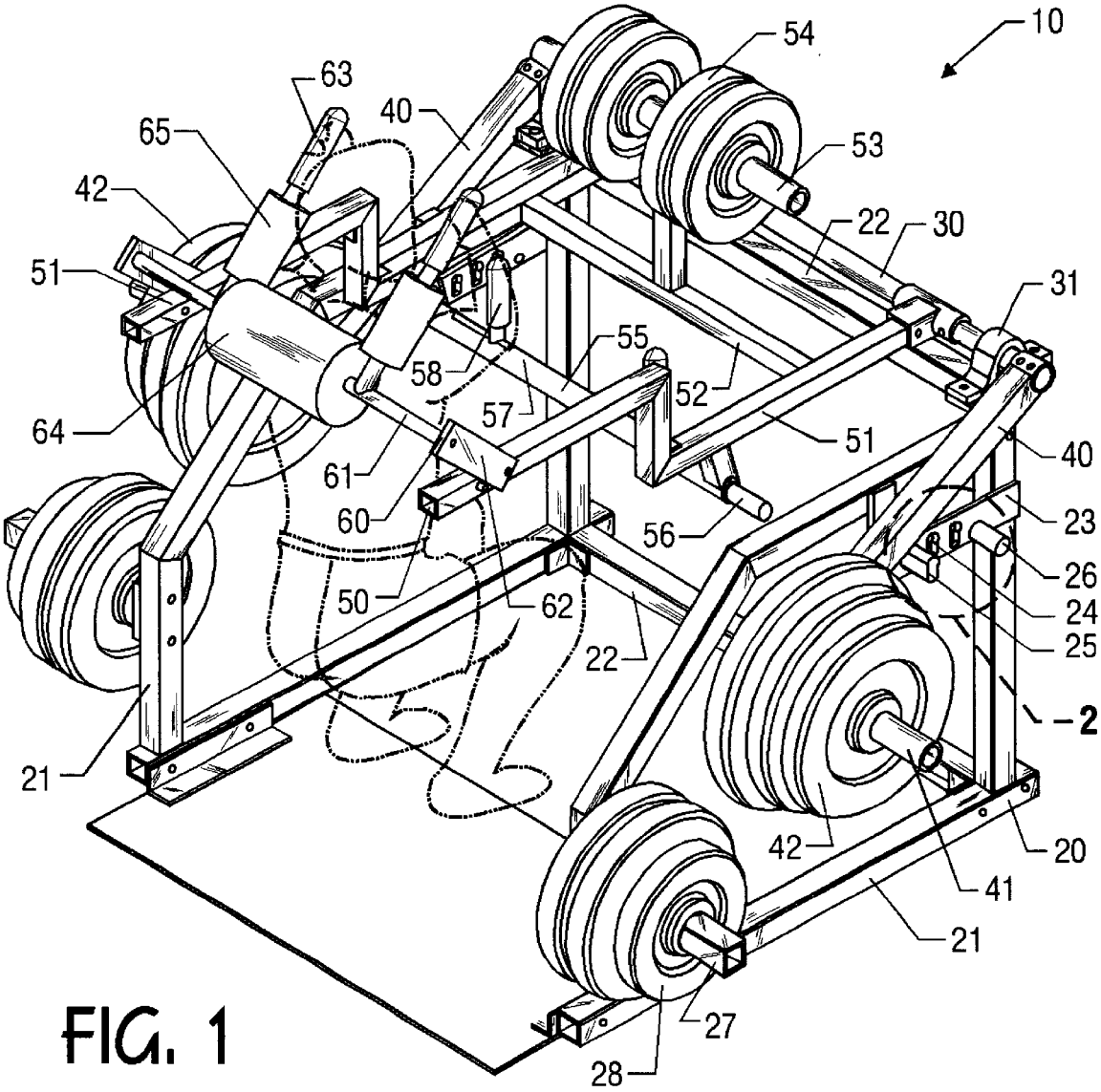
FIG. 1 is a perspective view of a squat exercise machine in accordance with a preferred embodiment of the invention showing the squat machine in a first position coinciding with the initial, squatting position of a squat exercise, an exerciser being shown in phantom.

FIG. 1 shows a preferred embodiment 10 of the squat exercise machines of the subject invention. In accordance therewith, the machine 10 has a support frame 20. When viewed from above, the frame 20 has a more or less U-shape wherein the exerciser is positioned at the open end of the "U" when performing a squat exercise on the machine. More specifically, the frame 20 comprises two generally rectangular side frame members 21. The front, upper corner of each side frame member 21 is truncated to allow an exerciser greater freedom of movement. The side frame members 21 are interconnected by a pair of beams 22 that extend between the side frame members 21 at the rearward, lower and upper ends thereof.

Preferably, the frame 20, including the side frame members 21 and the beams 22, are made of a number of straight sections of heavy-duty steel that may be welded, bolted, or interconnected with various types of connectors. The frame 20, however, may be made of any material, such as various plastic composite materials, that are sufficiently strong to bear the load of the weights that are carried on the machine.

It will be appreciated that the generally U-shaped frame 20 described above provides a relatively large footprint, thus ensuring the stability of the machine 10 when weights are added and removed. It provides an exerciser with sufficient room to perform squats and comprises a minimal number of components. While the frame 20 is for such reasons preferred, the precise configuration of the frame forms no part of the subject invention. The frame of the novel squat exercise machines may be configured in various ways so long as the configuration accommodates an exerciser and carries the weights and other components of the machine in a stable fashion.

A shaft is horizontally mounted on the support frame of the novel squat exercise machines for rotation about the shaft's longitudinal axis. In the preferred embodiment 10, a shaft 30 extends horizontally across the upper, rearward part of frame 20 near to the upper beam 22. Shaft 30 is mounted for rotation about its longitudinal axis by pillow block bearings 31 mounted on side frame members 21, although other known types of bearings and other means for mounting the shaft 30 may be used. Similarly, while the preferred embodiment comprises a single shaft 30, a split shaft comprising two separate shaft pieces that are longitudinally aligned may also be used. The shaft preferably is composed of heavy-duty steel.

The novel exercise machines comprise at least one weight arm that is connected to the shaft, and preferably, they comprise two weight arms so as to balance the load across the machine. The weight arms are adapted to carry a weight at a point distant from the connection between the weight arm and the rotating shaft. The weight arms provide resistance to rotation of the shaft.

In the preferred embodiment 10, a pair of weight arms 40 are connected to the shaft 30 at opposite ends thereof. The weight arms 40 extend substantially perpendicular to the longitudinal axis of the shaft 30. The lower ends of the weight arms 40 include hubs 41 which are adapted to hold one or more removable weights 42 at a point distant from their respective connections to the shaft 30. It will be appreciated, therefore, that weight arms 40 and weights 42 provide resistance to rotation of the shaft 30 and that when shaft 30 is rotated weight arms 40 and weights 42 follow an arcuate path about the longitudinal axis of shaft 30.

The weight arms 40 may be made of similar materials as described above in reference to the frame 20. Likewise, they may be welded or interconnected by any suitable means to the shaft 30. The length and shape of the weight arms also may be varied in order to accommodate movement of the weights and an exerciser.

Further in accordance with the subject invention, the novel squat machines comprise a work arm. The work arm is connected to the shaft such that actuation of the work arm by an exerciser causes the shaft to rotate. Preferably, the work arm is connected to the shaft at a point distant from the connection from the connection between the shaft and weight arm so as to accommodate an exerciser safely outside the path traveled by the weight arms.

In the preferred embodiment 10, a work arm 50 includes a pair of arm pieces 51 that extend radially from the shaft 30. The arm pieces 51 have a stepped portion, so that they more comfortably accommodate a typical exerciser, and are interconnected by a beam 52. The work arm 50 is connected to the shaft at points intermediate of the connection between the weight arms 40 and shaft 30. Thus, an exerciser stands clear of the path of weight arms 40 during the course of performing a squat.

The novel exercise machines further comprise a yoke. The yoke is connected to the work arm and is adapted to accommodate the shoulders of an exerciser. Thus, the exerciser may provide upward force on the work arm to overcome the resistance provided by the weight arms by performing a squat exercise. That, in turn, causes the shaft to rotate and the weight arm to travel along an arcuate path. Preferably, the yoke is pivotally connected to the work arm to provide greater comfort to an exerciser.

For example, the preferred embodiment 10 has a yoke 60 that is pivotally connected to the work arm 50 near the ends of the arm pieces 51. The yoke 60 is generally U-shaped, having a cross member 61 and a pair of legs 62 that extend at the ends thereof into a connection with the work arm 50. A pair of handles 63 extends radially from cross member 61, which handles 63 may be gripped by an exerciser while performing a squat. Suitable pads 64 and 65 are provided, respectively, on the cross member 61 and handles 63. Thus, the cross member 61 is adapted to lie across the back portion of an exerciser's shoulder while the handles 63 extend across the upper part of the shoulders. The exerciser, therefore, is able to actuate the work arm 50 to overcome the resistance provided by weight arms 40 and cause the shaft 30 to rotate and weights 42 to travel along an arcuate path.

The precise configuration of the weight arm and yoke, however, may be varied in any manner consistent with the comfort and range of motion of an exerciser. For example, the yoke cross member could be pivotally mounted to the legs, instead of the legs being pivotally mounted to the work arm. The precise size and configuration of the yoke may be varied to accommodate exercisers of different sizes, and the yoke could be removeably attached so as to allow different size yokes to be used with the same weight machine. Those components also may be fabricated from materials and interconnected as described above in reference to the frame 20 and weight arms 40.

In accordance with a preferred aspect of the subject invention, the novel exercise machines may further comprise second weights carried on the work arm at a point distant from the connection between the work arm and the rotating shaft. Such second weights provide resistance to upward movement of the work arm and travel along an arcuate path relative to the longitudinal axis of the rotating shaft.

In the illustrated embodiment, the work arm 50 includes an upstanding, T-shaped hub 53 that carries one or more weights 54. The weights 54 are carried on the work arm 50 distant from the connection between the work arm 50 and the shaft 30. Thus, weights 54 provide resistance and load, respectively, as an exerciser rises and lowers his body in performing a squat exercise. Moreover, during the course of lifting and lowering the work arm 50 during a squat, weights 54 will travel along an arcuate path relative to the shaft 30.

From the foregoing description, it will be appreciated that because the weights carried on the novel exercise machines travel along arcuate paths the exerciser experiences variable resistance from those weights during the course of a squat exercise. Thus, the exerciser not only is able to focus resistance on particular muscle groups, but also to provide a substantially constant resistance similar to that experienced with free weights.

More specifically, and as shown in FIG. 1, when an exerciser assumes an initial, squatting position, weights 42 on weight arms 40 preferably are carried at a position of between 180° and 270° relative to the longitudinal axis of the shaft 30, with 0° being an upright, vertical position and rotation being in a clockwise direction. That is, as viewed along the longitudinal axis of shaft 30 from the perspective of FIG. 11, the starting position of the weights 42 preferably is from the downward vertical position (180°) to the left horizontal position (270°). Thus, weights 42 on weight arms 40 will provide resistance to rotation of the shaft 30, the amount of resistance being dependent not only on the weight of the weights themselves, but also on the extent to which the weights 42 are carried off vertical. At vertical (180°), the initial resistance of weights 42 is essentially zero. The resistance provided by weights 42 will be the greatest and substantially equal to the nominal resistance of weights 42 when the starting position is horizontal (270°).

Figure 3:
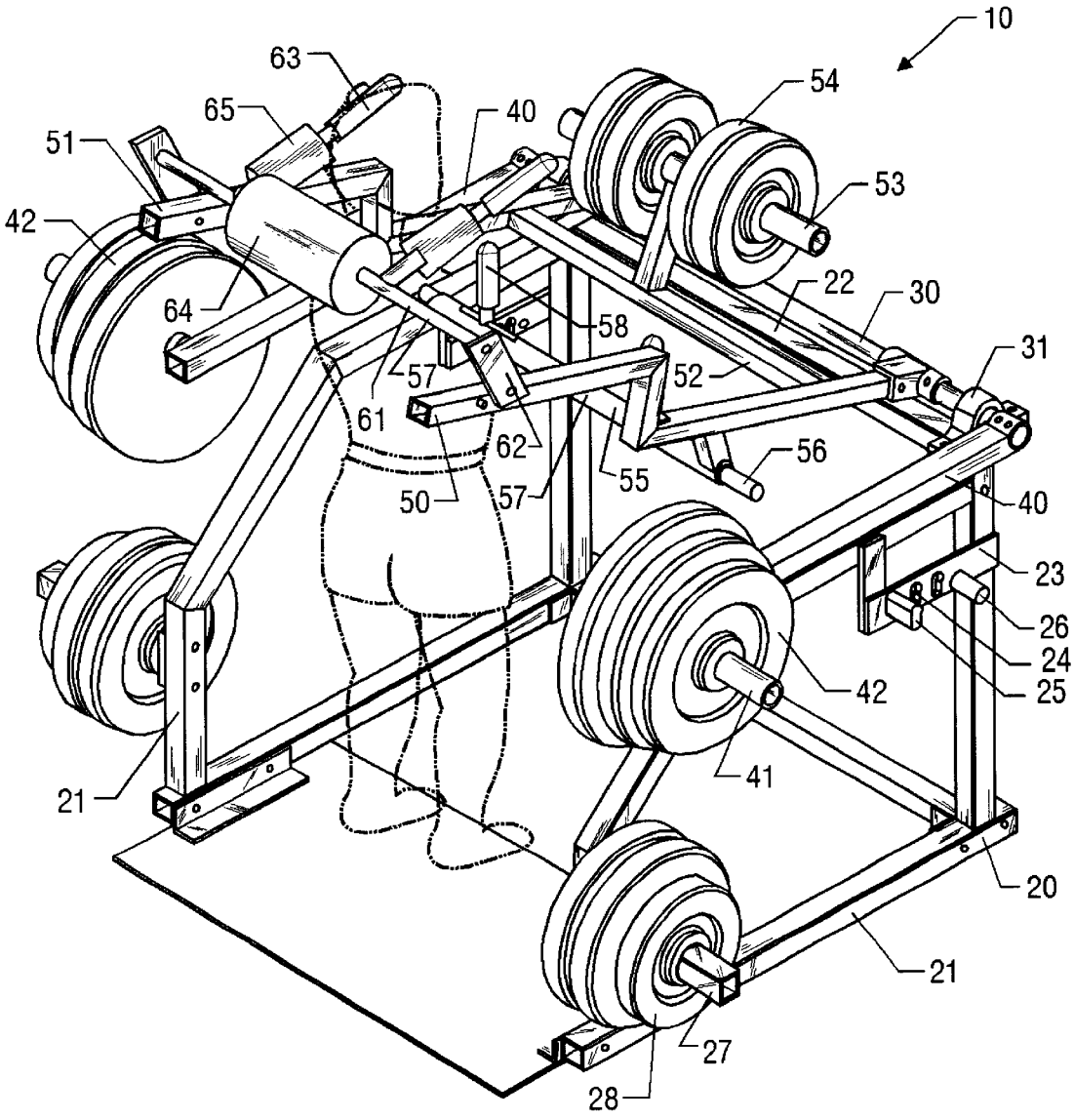
FIG. 3 is a perspective view of the exercise machine of FIG. 1 wherein the machine has moved to a second position coinciding with the finish, upright position of a squat exercise.

As the exerciser rises from the squatting position, the work arm 50 causes the shaft 30 to rotate in a clockwise direction which, in turn, causes weight arms 40 and their associated weights 42 (when viewed from the perspective of FIG. 1) to travel clockwise along arcuate paths. The resistance provided by weights 42, therefore, increases as they travel along their arcuate paths. As shown in FIG. 3, preferably weights 42 are approaching horizontal (270°) as the exerciser is approaching his full upright position and finishes in a substantially horizontal position. At that point weights 42 are providing resistance substantially equal to their nominal resistance.

Weights 42, therefore, provide less resistance when the exerciser is in the vulnerable, squatting position. They will provide their greatest resistance near the finish position at a point where the quadriceps are providing the greatest lift and the exerciser is at less risk of injury.

Figure 2:
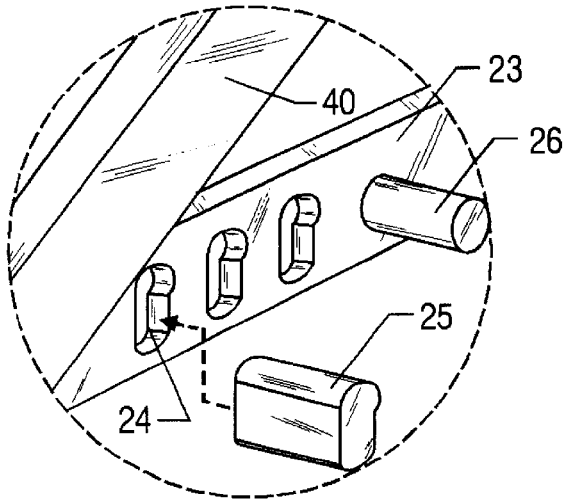
FIG. 2 is an enlarged area of a portion of FIG. 1 showing a preferred mechanism for varying the starting position of the weight arms.

Preferably, the novel exercise machines include means for varying the amount of initial resistance provided by the weights relative to their maximum resistance. For example, as shown in the preferred embodiment, frame 20 comprises an L-shaped corner plate 23 that has a number of slots 24. A pin 25 may be selectively inserted into slots 24, as best seen in FIG. 2. When pin 25 is inserted into a slot 24, it will support weight arms 40 at a desired initial angle. Thus, an exerciser is about to vary the amount of initial resistance provided by weights 42 by varying the initial angle of work arms 40.

That system is simple, easily constructed and operated, and effectively allows an exerciser to vary the amount of initial resistance experienced in a squat relative to the maximum resistance of the machine. Other means of varying the initial resistance are known in the art, however, and may be used in the novel exercise machines.

The weights 54 carried on work arm 50 preferably are positioned between 270° and 0° relative to the longitudinal axis of shaft 30 when the exerciser is in the initial, squatting position, with 0° being an upright, vertical position and rotation being in a clockwise direction. That is, as viewed along the longitudinal axis of shaft 30 from the perspective of FIG. 1, the starting position of the weights 54 preferably is from the left horizontal position (270°) to an upright, vertical position (0°). Weights 54, therefore, provide resistance to upward movement of the work arm 50. The amount of initial resistance relative to the nominal resistance of weights 54 depends on the extent to which weights are off vertical. That is, at horizontal (270°), weights 54 are providing their greatest resistance, which resistance is substantially equal to their nominal resistance. At vertical (0°) the resistance is substantially zero.

As the exerciser lifts the work arm 50, weights 54 travel clockwise along arcuate paths to substantially vertical (0°) finishing positions, as shown in FIG. 3. Thus, the resistance provided by weights 54 decreases as the exerciser progresses toward the finish position. In the finish position the resistance of weights 54 will approach zero. Because the exerciser is a greatest risk of injury in his squatting position, typically the work arm 50 will not carry as much weight and provide as much resistance as weights 42 on weight arms 40.

It will be appreciated, however, that by selectively varying the amount of weight carried on the weight arms and on the work arms, the novel squat exercise machines may focus resistance either through the initial range of motion, where most of the lift is provided by the gluteus maximus and hamstrings, or through the latter range of motion, where most of the lift is provided by the quadriceps. For example, little or no weight could be placed on the work arm 50. In that event, an exerciser is able to focus his exercise on his quadriceps, since the maximum resistance provided by the machine will occur as the exerciser approaches his upright, finish position and the quadriceps are doing most of the work. If relatively little weight is placed on the weight arms 40 and relatively more is placed on the work arm 50, the exerciser is able to focus on his gluteus maximus and hamstrings. The machine will provide maximum resistance through the initial range of motion where those muscles are performing most of the work.

Weights 42 and 54 also may be selected such that the increasing resistance provided by weights 42 on weight arms 40 is substantially offset by the decreasing resistance provided by weights 54 on work arm 50. Thus, the overall resistance provided by the machine may be made substantially constant over the entire range of motion and made to match the nominal resistance and resistance profile of free weights, i.e., the resistance that would be experienced by an exerciser doing squat exercises with a given amount of free weights. The relative amount of weights to be placed on weight arms 40 and work arm 50 will depend on their respective lengths and the starting positions of the weights 42 and 54, but it may be readily determined by those of ordinary skill in the art.

The novel exercise machines also preferably include means designed to limit the travel of the weight and work arms. For example, a safety slide 55 is carried on work arm

50. In the preferred embodiment, it is simply a rod 56 that is fitted to slide back and forth through a tubular cross member 57. Rod 56 may be reciprocated by gripping a handle 58 connected thereto and extend through a slot in cross member 57.

When rod 56 is slid (from the perspective of the exerciser) to the right, its end will extend over the top of the right side frame member 21. When rod 56 is in that position, it supports work arm 50 such that an exerciser may step under work arm 50 to begin his set. After the exerciser has assumed a comfortable, upright position, rod 56 may be slid to the left such that it clears right side frame member 21 as work arm 50 is lowered and raised by the exerciser performing his squat exercises.

Frame 20 also is provided with a safety stop 26. It is positioned such that weight arms 40 are prevented from swinging into a vertical position. Thus, if an exerciser were to collapse during the course of an exercise, movement of weight arms 40 and in turn work arm 50 would be restricted, and the exerciser would be protected from injury.

The safety slide 55 and safety stop 26 are preferred because they provide effective protection for an exerciser, yet they are relatively simple in design and easily constructed. It will be appreciated, however, that various means for restricting the movement of the weight and work arms are known in the art and may be adapted for use in the novel exercise machines.

Frame 20 also preferably includes a pair of hubs 27 adapted to hold extra weights 28. Weights 28, along with weights 42 and 54, may be any commercially available weights. They may be secured to their respective hubs by various retainers, of which a variety are known in the art and may be used in the novel exercise machines. Although removable weights generally are desired because they allow an exercise to select an appropriate resistance, weights also could be permanently affixed to the weight or work arms, or a combination of fixed and removable weights could be used.

It also will be appreciated that, because the machine does not require levers, pulleys, cables, or other specialized components, it is relatively simple and inexpensive to manufacture. Assembly of the machine also is easy and not time intensive. Thus, the machine 10 can be offered at a decreased cost to the exerciser.

While a preferred embodiment of this invention has been described, it is to be understood that the invention is not limited thereby and may cover other embodiments. For example, the squat machine may include stations for other exercises or may be adaptable to accommodate other exercises, as shown in the aforementioned '476 application. Likewise, the novel machines may have separate shafts for the work arm and the weight arms that are rotatably interconnected, e.g., by gears. While such an arrangement increases the complexity of the machine, it would allow the machine to have a narrower, longer footprint, and such footprints may be preferred for the layout of particular exercise rooms. Other variations and embodiments will be obvious to those of ordinary skill in the art from the description herein.

What is claimed is:

1. An exercise machine for performing squat exercises, said exercise machine comprising:

a support frame;

a shaft horizontally mounted on said frame for rotation about its longitudinal axis;

at least one weight arm connected to said shaft, said weight arm carrying one or more first weights at a point distant from said connection between said weight arm and said rotating shaft to provide resistance to rotation of said shaft, said first weights having a nominal weight;

a work arm connected to said shaft such that actuation of the work arm causes said shaft to rotate;

said work arm carrying one or more second weights at a point distant from said connection between said work arm and said rotating shaft to provide resistance to upward movement of said work arm;

a yoke connected to said work arm, said yoke adapted to accommodate the shoulders of an exerciser such that the exerciser may provide upward force on said work arm in opposition to said resistances by performing a squat exercise and thereby causing said work arm to travel along an arcuate path, said shaft to rotate, and said weight arm to travel along an arcuate path;

whereby said resistance to upward rotation of said work arm and said resistance to rotation provided by said first weight arm vary as said work arm and said weight arm travel along arcuate paths.

2. The exercise machine of claim 1, wherein said shaft is mounted on said frame by pillow block bearings.

3. The exercise machine of claim 1, wherein said yoke is releasably connected to said work arm.

4. The exercise machine of claim 1, wherein said weight arm is adapted to releasably carry weights of different resistance.

5. The exercise machine of claim 1, wherein said exercise machine comprises means for supporting said weight arm in one or more substantially non-vertical positions to adjust the resistance provided by said weight arm to movement from a resting position on said support means.

6. The exercise machine of claim 1, wherein said yoke is pivotally connected to said work arm.

7. The exercise machine of claim 1, wherein said first and second weights are selected to provide resistance approximating the resistance that would be experienced by an exerciser doing squat exercises with a predetermined amount of free weights.

8. The exercise machine of claim 1, wherein said first and second weights are selected to focus resistance on the gluteus maximus and hamstring muscles of an exerciser.

9. The exercise machine of claim 1, wherein said first and second weights are selected to focus resistance on the quadriceps of an exerciser.

10. An exercise machine for performing squat exercises, said exercise machine comprising:

a support frame;

a shaft horizontally mounted on said support frame for rotation about its longitudinal axis;

at least one weight arm connected to said shaft and extending substantially perpendicular to said longitudinal axis of said shaft, said weight arm carrying one or more first weights at a point distant from said connection to said shaft to provide resistance to rotation of said shaft;

a work arm connected to said shaft at a point distant from said connection between said shaft and said weight arm, said work arm being connected to said shaft such that actuation of said work arm causes said shaft to rotate;

said work arm carrying one or more second weights at a point distant from said connection between said work arm and said rotating shaft to provide resistance to upward movement of said work arm;

a yoke connected to said work arm, said yoke adapted to accommodate the shoulders of an exerciser such that the exerciser may provide upward force on said work arm in opposition to said resistance by performing a squat exercise, whereby said first and second weights, upon actuation of said work arm by the exerciser, are carried along arcuate paths relative to said longitudinal axis of said shaft from respective first positions corresponding to the initial, squatting position of the exerciser to respective second positions corresponding to the finish, upright position of the exerciser;

whereby said resistance to upward rotation of said work arm and said resistance to rotation provided by said first weight arm vary as said work arm and said weight arm travel along arcuate paths.

11. The exercise machine of claim 10, wherein said weight arm is adapted to carry weights from a first position of between 180° and 270° and a substantially horizontal second position.

12. The exercise machine of claim 10, wherein said work arm is adapted to carry said second weights from a first position of between 270° and 0° to a substantially vertical second position.

13. The exercise machine of claim 10, wherein said exercise machine comprises means for supporting said weight arm in one or more substantially non-vertical positions to adjust the resistance provided by said weight arm to movement from a resting position on said support means.

14. The exercise machine of claim 10, wherein said yoke is pivotally connected to said work arm.

15. The exercise machine of claim 10, wherein said first and second weights are selected to provide resistance approximating the resistance that would be experienced by an exerciser doing squat exercises with a predetermined amount of free weights.

16. The exercise machine of claim 10, wherein said first and second weights are selected to focus resistance on the gluteus maximus and hamstring muscles of an exerciser.

17. The exercise machine of claim 10, wherein said first and second weights are selected to focus resistance on the quadriceps of an exerciser.

18. An exercise machine for performing squat exercises, said exercise machine comprising:

a support frame;

a shaft horizontally mounted on said support frame for rotation about its longitudinal axis;

a pair of weight arms connected to said shaft at opposite ends thereof and extending substantially perpendicular to said longitudinal axis of said shaft, said weight arms carrying one or more first weights at a point distant from the respective connections of said weight arms to said rotating shaft to provide resistance to rotation of said shaft, said first weights having a nominal weight;

a work arm connected to said shaft at a point intermediate of said connections between said weight arms and said shaft, said work arm connected to said shaft such that actuation of the work arm causes said shaft to rotate;

said work arm carrying one or more second weights at a point distant from said connection between said work arm and said rotating shaft to provide resistance to upward movement of said work arm;

a yoke connected to said work arm, said yoke adapted to accommodate the shoulders of an exerciser such that the exerciser may provide upward force on said work arm in opposition to said resistance by performing a squat exercise, whereby said first and second weights, upon actuation of said work arm by the exerciser, are carried along arcuate paths relative to said longitudinal axis of said shaft from respective first and second positions;

whereby said resistance to upward rotation of said work arm and said resistance to rotation provided by said first weight arm vary as said work arm and said weight arm travel along arcuate paths from their respective first and second positions.

19. The exercise machine of claim 18, wherein said yoke is pivotally connected to said work arm.

20. The exercise machine of claim 18, wherein said first and second weights are selected to provide resistance approximating the resistance that would be experienced by an exerciser doing squat exercises with a predetermined amount of free weights.

21. The exercise machine of claim 18, wherein said first and second weights are selected to focus resistance on the gluteus maximus and hamstring muscles of an exerciser.

22. The exercise machine of claim 18, wherein said first and second weights are selected to focus resistance on the quadriceps of an exerciser.

* * * * *